US009815271B2

(12) United States Patent
Kushida et al.

(10) Patent No.: US 9,815,271 B2
(45) Date of Patent: Nov. 14, 2017

(54) INTERMEDIATE TRANSFER MEMBER, IMAGE RECORDING APPARATUS, AND IMAGE RECORDING METHOD

(71) Applicant: CANON KABUSHIKI KAISHA, Tokyo (JP)

(72) Inventors: Midori Kushida, Tokyo (JP); Mitsutoshi Noguchi, Kawaguchi (JP); Yoshikazu Saito, Inagi (JP); Norio Ohkuma, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/211,014

(22) Filed: Jul. 15, 2016

(65) Prior Publication Data

US 2017/0028710 A1 Feb. 2, 2017

(30) Foreign Application Priority Data

Jul. 28, 2015 (JP) ..... 2015-148505

(51) Int. Cl.

| | |
|---|---|
| ***B41J 2/005*** | (2006.01) |
| ***B41M 5/00*** | (2006.01) |
| ***B41M 5/025*** | (2006.01) |
| ***B41M 5/03*** | (2006.01) |
| ***B41M 5/52*** | (2006.01) |
| ***B41J 2/01*** | (2006.01) |

(52) U.S. Cl.

CPC ..... *B41J 2/0057* (2013.01); *B41J 2/01* (2013.01); *B41M 5/0017* (2013.01); *B41M 5/0256* (2013.01); *B41M 5/03* (2013.01); *B41M 5/529* (2013.01); *B41J 2002/012* (2013.01)

(58) Field of Classification Search

CPC ..... B41J 2/0057; B41J 2002/012; B41J 2/01

See application file for complete search history.

(56) References Cited

U.S. PATENT DOCUMENTS

| | | | |
|---|---|---|---|
| 5,932,355 | A | 8/1999 | Iqbal et al. |
| 6,682,189 | B2 | 1/2004 | May et al. |
| 6,767,092 | B2 | 7/2004 | May et al. |
| 8,177,351 | B2 | 5/2012 | Taniuchi et al. |
| 8,287,117 | B2 | 10/2012 | Ageishi |
| 8,876,275 | B2 | 11/2014 | Kanasugi et al. |
| 9,354,557 | B2 | 5/2016 | Noguchi |

(Continued)

FOREIGN PATENT DOCUMENTS

| | | | |
|---|---|---|---|
| EP | 1 493 591 | A2 | 1/2005 |
| JP | 2003-182064 | A | 7/2003 |

(Continued)

OTHER PUBLICATIONS

Extended European Search Report in European Application No. 16180712.8 (dated Nov. 29, 2016).

*Primary Examiner* — Kristal Feggins
(74) *Attorney, Agent, or Firm* — Fitzpatrick, Cella, Harper & Scinto

(57) ABSTRACT

An intermediate transfer member for use in a transfer-type image recording method including the steps of applying an ink to an intermediate transfer member to form an intermediate image and transferring the intermediate image to a recording medium. The intermediate transfer member includes a surface layer part onto which an ink is applied, the surface layer part containing an organic siloxane compound having a siloxane bond and a polyalkylene oxide unit.

20 Claims, 2 Drawing Sheets

(56) References Cited

U.S. PATENT DOCUMENTS

| | | | |
|---|---|---|---|
| 9,359,538 | B2 | 6/2016 | Tsutsui et al. |
| 2010/0245511 | A1 | 9/2010 | Ageishi |
| 2013/0147889 | A1 | 6/2013 | Kanasugi et al. |
| 2013/0224651 | A1 | 8/2013 | Kanasugi et al. |
| 2014/0309329 | A1 | 10/2014 | Sawada et al. |

FOREIGN PATENT DOCUMENTS

| | | | |
|---|---|---|---|
| JP | 2008-018719 | A | 1/2008 |
| JP | 2010-228193 | A | 10/2010 |

INTERMEDIATE TRANSFER MEMBER, IMAGE RECORDING APPARATUS, AND IMAGE RECORDING METHOD

BACKGROUND OF THE INVENTION

Field of the Invention

The present invention relates to an intermediate transfer member for transfer-type image recording and a transfer-type image recording apparatus and a transfer-type image recording method using the intermediate transfer member.

Description of the Related Art

As an image recording method using an ink, a transfer-type image recording method is known. In the method, an ink is applied to an image forming surface of an intermediate transfer member to form an intermediate image, then the formed intermediate image is transferred to a recording medium, and an image is formed on the recording medium. The intermediate transfer member used in the image recording method preferably has such a characteristic that the surface thereof easily releases an intermediate image, i.e. good transferability of an intermediate image.

To achieve good transferability of an intermediate image from an intermediate transfer member to a recording medium, it has been considered to be important to reduce a surface free energy of the intermediate transfer member. On this account, the surface (surface layer part) of an intermediate transfer member has been typically made of a material having a low surface free energy, i.e. a highly water-repellent material, such as fluorine resins and silicon resins (see Japanese Patent Application Laid-Open No. 2003-182064). The intermediate transfer member surface formed of such a material has a surface free energy of about 110 degrees in terms of "contact angle for pure water", which is a typical index of the surface free energy.

While, to achieve holding properties and transferability of an intermediate image on an intermediate transfer member, another transfer-type image recording method is disclosed. In the method, an ultraviolet curable solution layer having ink affinity and fixability is previously formed on an intermediate transfer member (see Japanese Patent Application Laid-Open No. 2010-228193). In this image recording method, an ink is applied to the curable solution layer on an intermediate transfer member to form an intermediate image, then the ultraviolet curable solution layer holding the intermediate image is transferred from the intermediate transfer member to a recording medium, and the recording medium is irradiated with ultraviolet rays to form an image.

SUMMARY OF THE INVENTION

An intermediate transfer member for transfer-type image recording of the present invention is used in a transfer-type image recording method that includes the steps of applying an ink to an intermediate transfer member to form an intermediate image and transferring the intermediate image to a recording medium. The intermediate transfer member has a surface layer part onto which an ink is applied, and the surface layer part contains an organic siloxane compound having a siloxane bond and a polyalkylene oxide unit.

A transfer-type image recording method of the present invention includes the steps of applying an ink to an intermediate transfer member to form an intermediate image and transferring the intermediate image to a recording medium. In the transfer-type image recording method, the intermediate transfer member is the intermediate transfer member having the above-mentioned structure of the present invention.

A transfer-type image recording apparatus of the present invention includes an intermediate transfer member, an ink applying unit for applying an ink to the intermediate transfer member to form an intermediate image, and a transfer unit for transferring the intermediate image to a recording medium. In the transfer-type image recording apparatus, the intermediate transfer member is the intermediate transfer member having the above-mentioned structure of the present invention.

According to the present invention, an intermediate transfer member having good image formability obtained by using an ink and an aggregation liquid used as needed and having an image forming surface of which the hydrophilicity is unlikely to be changed even by repeated transfer as well as a transfer-type image recording apparatus and a transfer-type image recording method using the intermediate transfer member can be provided.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

By applying, onto an image forming surface of an intermediate transfer member, an ink and an aggregation liquid that has a function of aggregating ink components and is used as needed, an intermediate image can be formed. During such image formation, in order to further improve image formability and transferability of an intermediate image on the image forming surface of an intermediate transfer member, it is required that an intermediate image be satisfactory transferred to a recording medium while the image forming surface maintain appropriate wettability with an ink and an aggregation liquid.

However, the study by the inventors of the present invention has revealed that the intermediate transfer member described in Japanese Patent Application Laid-Open No. 2003-182064 may be required to have an image forming surface with higher wettability with respect to an ink and an aggregation liquid in some cases to achieve the above requirements for the intermediate transfer member.

When the intermediate transfer member described in Japanese Patent Application Laid-Open No. 2010-228193 is used, the curable solution layer can absorb and fix an ink to achieve image holding properties. However, the curable solution layer itself is transferred together with the ink onto a recording medium side, and thus the formation of the curable solution layer on the intermediate transfer member and the release thereof from the intermediate transfer member are repeated when the intermediate transfer member is repeatedly used. This causes the intermediate transfer member to have lower hydrophilicity with respect to the curable solution layer and thus impairs good formation of the curable solution layer in some cases. In addition, in image formation using the intermediate transfer member described in Japanese Patent Application Laid-Open No. 2010-228193, materials for the curable solution layer are consumed every image formation, the number of image formation steps increases, and the cost for forming images rises in some cases.

The present invention therefore intends to provide an intermediate transfer member for transfer-type image recording having good image formability obtained by using an ink and an aggregation liquid used as needed and having surface hydrophilicity that is unlikely to be changed even by repeated transfer. The present invention also intends to provide an image recording apparatus and an image recording method using the intermediate transfer member.

The present invention will now be described in detail.

Intermediate transfer member for transfer-type image recording (intermediate transfer member for transfer-type ink jet recording)

Schematic views of the structures of intermediate transfer members for transfer-type ink jet recording as embodiments of the present invention are shown in FIGS. 1A to 1D.

Figure 1A:
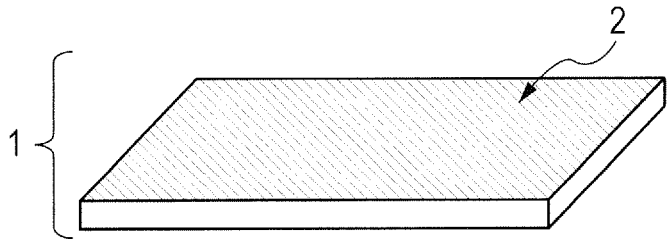
FIGS. 1A, 1B, 1C, and 1D are schematic views of the structures of intermediate transfer members of the present invention.

The intermediate transfer member 1 shown in FIG. 1A has a surface layer part 2. The image forming surface of the intermediate transfer member 1 is on the surface layer part 2 (surface side). Onto the image forming surface, an ink is applied by using an ink jet device to form an intermediate image.

The intermediate transfer member of the present invention preferably has appropriate elasticity because an intermediate image is transferred by pressing the intermediate image against a recording medium such as paper. On this account, for example, if a plain paper is used as the recording medium, the intermediate transfer member is preferably, at least partly formed of an elastic material. The part formed of the elastic material preferably has a durometer type A hardness (in accordance with JIS K6253) of 10 degrees or more to 100 degrees or less. The lower limit thereof is more preferably 20 degrees or more, and the upper limit is more preferably 60 degrees or less.

The intermediate transfer member may have a single layer structure or a multilayer structure composed of a plurality of layers.

Figure 1B:
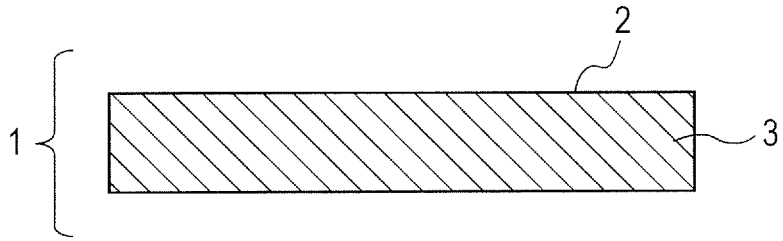

The single layer structure is exemplified by a structure using the surface of a base layer 3 as the surface layer part 2 as shown in the schematic cross-sectional view in FIG. 1B. The multilayer structure is exemplified by structures in which a surface layer 2 is provided on a base layer 3 having a single layer structure or a double layer structure (3*a*, 3*b*) and the surface layer 2 is the surface layer part 2 constituting the image forming surface, as shown in the schematic cross-sectional views in FIGS. 1C and 1D. The base layer 3 may have a multilayer structure including three or more layers.

The intermediate transfer member may have a compressible elastic layer having such an elasticity that the layer can be compressed by pressing and can be returned to the original shape upon release of the pressure, in order to uniformize the pressure when the intermediate transfer member is pressed against a recording medium for transfer.

Figure 1C:
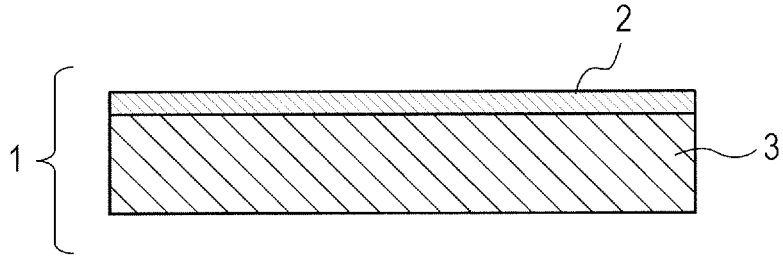
Figure 1D:
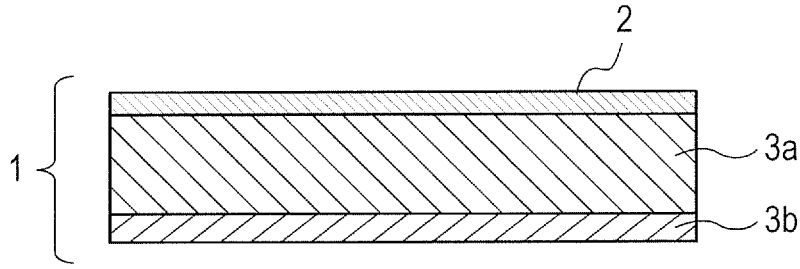

Such an elastic layer can be used at least in the base layer 3 shown in FIGS. 1B, 1C, and 1D.

The intermediate transfer member may further include a resin layer, a base fabric layer, a metal layer, and the like, in order to have elastic properties, strength, and thermal properties, for example.

As the material for forming the elastic layer, various rubber materials or various elastomer materials can be used in terms of process characteristics or the like. The elastic layer can be provided in the form of a continuous layer or a porous layer.

Examples of the elastomer material and the rubber material include silicone rubbers, fluorosilicone rubbers, phenyl silicone rubbers, fluororubbers, chloroprene rubbers, nitrile rubbers, ethylene-propylene rubbers, natural rubbers, styrene rubbers, isoprene rubbers, butadiene rubbers, ethylene/propylene/butadiene copolymers, and nitrile-butadiene rubbers. Specifically, silicone rubbers, fluorosilicone rubbers, phenyl silicone rubbers, fluororubbers, and chloroprene rubbers are preferably used in terms of dimensional stability, durability, heat resistance, and the like.

The size of the intermediate transfer member 1 can be freely set according to the size of an intended print image. FIGS. 1A to 1D exemplify sheet-shaped intermediate transfer members 1, but the whole shape of the intermediate transfer member is not limited to them and is exemplified by, in addition to the sheet shape, a roller shape, a drum shape, a belt shape, and an endless web shape.

In the present invention, "surface layer part" means a part of the surface side on an intermediate transfer member. In the present invention, it is important that the surface layer part, which is the surface layer part of an intermediate transfer member onto which an ink is applied, contains an organic siloxane compound having a siloxane bond and a polyalkylene oxide (PAO) unit (PAO-modified polysiloxane compound). The material constituting the surface layer part is formed of at least a PAO-modified polysiloxane compound, and this organic siloxane compound is fixed to the surface layer part.

It is an essential requirement for exhibiting the advantageous effects of the invention that siloxane bonds and polyalkylene oxide units are fixed to the surface layer part of an image forming surface as described above. Hence, the surface layer part can be any portion that is exposed to the surface of an intermediate transfer member, and is not necessarily provided as a layer distinguished from a base. The surface layer part may be a surface region of an intermediate transfer member having a single layer (one layer) in which the surface region is formed as the surface layer part composed of a material containing the above organic siloxane compound. If an intermediate transfer member has a single layer structure, the whole of the intermediate transfer member may be formed of a material containing the PAO-modified polysiloxane compound, or only the surface layer part of the base may be formed of a material containing the PAO-modified polysiloxane compound. The method for forming a layer constituting the surface layer part that is provided as a layer is preferably a method of applying a coating solution containing the PAO-modified polysiloxane compound or a method of applying a coating solution that contains components of the PAO-modified polysiloxane compound and can form the PAO-modified polysiloxane compound after coating.

The surface layer part may have any thickness, but the thickness of the surface layer part is preferably 0.01 μm or more to 10.00 μm or less, more preferably 0.1 μm or more to 10.0 μm or less, and even more preferably 1.0 μm or more to 5.0 μm or less. In particular, if the surface layer part is formed by applying a coating solution, the surface layer part having a thickness within the above range can obtain more sufficient film strength, and this can suppress cracks on the surface layer part, delamination, or other defects caused by stress due to elastic deformation of the whole intermediate transfer member at the time of the transfer step of an intermediate image. In addition, the surface layer part can obtain appropriate elastic deformation and can follow the surface shape of a recording medium, resulting in better transferability.

If the surface layer part is provided as a layer on a base, the surface layer part preferably has sufficient adhesiveness to a base adjacent to the surface layer part, in addition to the thickness requirements of the surface layer part, in order to suppress generation of cracks, delamination, and reduction in transferability. In order to improve the adhesiveness, the surface of a base adjacent to the surface layer part (the area on which the surface layer part is provided) is preferably subjected to surface treatment.

The surface treatment is exemplified by flame treatment, corona treatment, plasma treatment, polishing treatment, roughening treatment, active-energy-ray-irradiation treatment (UV, IR, RF, for example), ozone treatment, and surfactant treatment. These treatments may be combined to perform the surface treatment. In order to further improve the adhesiveness and the coatability, a coating solution to form the surface layer part preferably contains a silane coupling agent, a sulfur-containing compound, or the like. The coating solution to form the surface layer part can be applied by conventionally known various coating methods. Examples of the coating method include die coating, blade coating, gravure coating, and methods combining such a coating method with offset roller coating.

To achieve good transferability, it is typically required to reduce the surface energy of an image forming surface of an intermediate transfer member, i.e. to increase the water repellency. However, such an image forming surface has lower holding properties of an aggregation liquid or an ink, resulting in deterioration of image qualities unfortunately.

As a result of intensive studies, the inventors of the present invention have found that the surface energy of an intermediate transfer member is not necessarily reduced, i.e. the water repellency is not necessarily increased. In other word, the inventors have found that if the surface layer part of an intermediate transfer member contains the above PAO-modified polysiloxane compound, good transferability can be achieved while image qualities are maintained due to appropriate hydrophilicity.

The image forming surface of the intermediate transfer member of the present invention preferably has a contact angle for pure water of 105 degrees or less, which varies depending on characteristics of an aggregation liquid or an ink. The contact angle for pure water is more preferably 80 degrees or less. If an image forming surface has a smaller contact angle for pure water, an aggregation liquid or an ink applied can be prevented from being repelled on the intermediate transfer member. The contact angle for a liquid such as pure water can be determined by using a common contact angle meter.

If the surface layer part is provided as a surface layer as described above to impart flexibility to the surface layer, generation of cracks on the surface layer and delamination are prevented to suppress the deterioration of transferability, and the performance following to a recording medium is increased to result in an improvement of the transferability. Such a structure is thus preferred. In the present invention, the PAO-modified polysiloxane compound contained in a surface layer contains a long chain functional group containing a polyalkylene oxide unit, and thus the surface layer can obtain flexibility. This is supposed to be because molecular chains in the skeleton have higher mobility to promote the relaxation of internal stress. However, if such a structure as a common long-chain alkyl group is used, an excess carbon number results in higher hydrophobicity, and this makes uniform hydrolysis or condensation reaction difficult. The carbon number is thus preferably 20 or less, and process conditions and the like are limited in some cases when such a structure is used. In contrast, in the present invention, an alkylene oxide group having higher polarity is introduced as the long chain structure, and thus the flexibility can be imparted while an appropriate hydrophilicity is maintained even with a group having a larger carbon number. In addition, by adjusting the type and the content of an alkylene oxide group according to characteristics of an ink or an aggregation liquid, the hydrophilicity of the surface layer can be controlled to achieve optimum image qualities. However, in order to achieve good transferability due to moderately low surface tackiness even if a polyalkylene oxide unit is used, the polyalkylene oxide unit preferably has a carbon number of 120 or less. The polyalkylene oxide unit more preferably has a carbon number of 6 to 100.

When an intermediate transfer member is repeatedly used, the hydrophilicity of the image forming surface may change. If the hydrophilicity of the image forming surface changes, conditions of an aggregation liquid or an ink applied change, and the qualities of images formed may change between transfer in the early stages and transfer after repetition. It is thus important for an intermediate transfer member to suppress the change in hydrophilicity of the image forming surface of the intermediate transfer member when the intermediate transfer member is used repeatedly.

The organic siloxane compound contained in the surface layer part of the present invention preferably has a siloxane bond in the molecular skeleton thereof and also preferably contains a polyalkylene oxide unit in the molecular skeleton. In the present invention, "in a skeleton" means a state in which a siloxane bond and a polyalkylene oxide unit form covalent bonds with other components, as components of the surface layer part of the intermediate transfer member and are immobilized, and differs from the state in which a siloxane bond and a polyalkylene oxide unit are simply attached to, adsorbed to, or infiltrated into the surface layer.

In this manner, the siloxane bond and the polyalkylene oxide unit are fixed to the surface layer part. In addition, both components are immobilized "in the skeleton". This prevents surface layer components from transferring to a recording medium and from disappearing at the time of transfer of an intermediate image, prevents surface layer components from bleeding due to change over time, and prevents surface layer components from disappearing by migration toward an aggregation liquid or toward an ink, for example. Accordingly, the change in hydrophilicity when the intermediate transfer member is used repeatedly can be suppressed.

Whether a siloxane bond and a polyalkylene oxide unit are integrated and immobilized in the molecular structure of an organic siloxane compound can be determined as follows: For example, a surface layer part of an intermediate transfer member is formed as a layer on a base; then the layer is released from the base and immersed in a good solvent such as methanol and benzene; the change in weight of the layer before and after the immersion is calculated; and a $^1$H-NMR spectrum after immersion is measured. As for the $^1$H-NMR, for example, a compound having a dimethylsiloxane component and a polyethylene oxide unit can be identified by the presence or absence of the peak of an ethylene oxide group (—$CH_2$—$CH_2$—O—, $\sigma$=3.5 to 4.5 ppm) and the peak of the terminal structure of a siloxane bond (—O—Si—$CH_3$, $\sigma$=0.0 to 0.2).

The PAO-modified polysiloxane compound as the constituent material of the surface layer part of the intermediate transfer member is preferably a condensation product of at least one of an organic silicon compound represented by General Formula (1) and an organic silicon compound represented by General Formula (2) which are hydrolyzable siloxane compounds to which a polyalkylene oxide (PAO) unit is introduced.

General Formula (1)

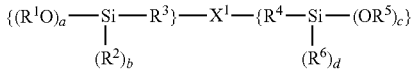

(In the formula, $X^1$ is a polyalkylene oxide unit containing $(X^2)_n$; $X^2$ is an alkylene oxide group having 2 to 4 carbon atoms; n is an integer of 3 to 50;

each of $R^1$ and $R^5$ is independently a hydrogen atom or an alkyl group having 1 to 4 carbon atoms;

each of $R^2$ and $R^6$ is independently a monovalent group having an alkyl group having 1 to 20 carbon atoms, a hydroxyl group, a carboxyl group, a vinyl group or a cyclic ether group;

each of a and c is independently an integer of 1 to 3; each of b and d is independently an integer of 0 to 2; a+b=3; c+d=3; and each of $R^3$ and $R^4$ is independently a divalent group containing an alkylene group having 1 to 20 carbon atoms, a urethane bond or a carbonyl group)

General Formula (2)

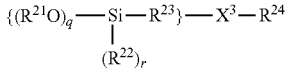

(In the formula, $X^3$ is a polyalkylene oxide unit containing $(X^4)_m$; $X^4$ is an alkylene oxide group having 2 to 4 carbon atoms; m is an integer of 3 to 50;

$R^{21}$ is a hydrogen atom or an alkyl group having 1 to 4 carbon atoms;

$R^{22}$ is a monovalent group having an alkyl group having 1 to carbon atoms, a hydroxyl group, a carboxyl group, a vinyl group or a cyclic ether group; q is an integer of 1 to 3; r is an integer of 0 to 2; q+r=3;

$R^{23}$ is a divalent group containing an alkylene group having 1 to 20 carbon atoms, a urethane bond or a carbonyl group; and $R^{24}$ is a monovalent group having a hydrogen atom, an alkyl group having 1 to 20 carbon atoms, a hydroxyl group, a carboxyl group, an ester group, a vinyl group or a cyclic ether group)

The organic silicon compounds represented by General Formulae (1) and (2) have at least one structure in which a hydroxy group or an alkyloxy group is bonded to Si.

The hydroxy group or alkyloxy group substituted with Si can form a siloxane bond by dehydration condensation reaction. If an alkyloxy group is bonded to Si, hydrolysis reaction proceeds. Hence, the organic silicon compound having at least one structure in which a hydroxy group or an alkyloxy group is bonded to Si is an organic silicon compound capable of forming a siloxane bond.

In the present invention, such a group allows at least one of the organic silicon compounds represented by General Formulae (1) and (2) to undergo condensation reaction, and consequently a compound having a siloxane bond in the skeleton thereof can be obtained.

$R^1$, $R^5$, and $R^{21}$ are specifically preferably any of a hydrogen atom, a methyl group, and an ethyl group from the viewpoint of reactivity.

The alkyl groups of $R^1$, $R^2$, $R^5$, $R^6$, $R^{21}$, and $R^{22}$ are substituted or unsubstituted alkyl groups, and the substituent of the substituted alkyl groups can be exemplified by a phenyl group.

The organic silicon compounds of General Formulae (1) and (2) have a polyalkylene oxide unit represented by $X^1$ or $X^3$.

The polyalkylene oxide unit ($X^1$) in General Formula (1) can be exemplified by the following units:

(A) a unit having one polyalkylene oxide group in which 3 to 50 alkylene oxide groups are bonded; and (B) a unit containing a structure in which a plurality of polyalkylene oxide groups in each of which 3 to 50 alkylene oxide groups are bonded are linked through linker groups (L).

The polyalkylene oxide unit ($X^3$) in General Formula (2) can be exemplified by the following unit:

(C) a unit having one polyalkylene oxide group in which 3 to 50 alkylene oxide groups are bonded.

The alkylene oxide group is specifically preferably an ethylene oxide group or a propylene oxide group from the viewpoint of hydrophilicity and reactivity. The polyethylene oxide group in which a plurality of alkylene oxide groups are bonded may be formed of a single type of alkylene oxide groups or may be formed of two or more types of alkylene oxide groups, such as a copolymerized unit of an ethylene oxide group and a propylene oxide group. It is preferable that the numbers of repeating units of alkylene oxide groups (n, m) are each independently 5 to 30 from the viewpoint of flexibility.

The polyalkylene oxide unit in (A) can be exemplified by units represented by —(O-Alk)-O— or —O-(Alk-O)$_n$— (where Alk is an alkylene group having 2 to 4 carbon atoms).

The polyalkylene oxide unit in (C) can also be exemplified by units represented by —(O-Alk)-O— or —O-(Alk-O)$_m$— (where Alk is an alkylene group having 2 to 4 carbon atoms).

The linker group (L) in the structure in (B) can be exemplified by linker groups containing an alkylene group which may be substituted. Such a linker can be exemplified by a propylene group substituted with a methyl group at the 2-position. The polyalkylene oxide unit formed by using the propylene group as the linker group has the following structure.

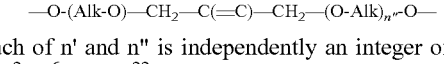

(each of n' and n" is independently an integer of 3 to 50)

$R^2$, $R^6$, and $R^{22}$ in General Formulae (1) and (2) may be a monovalent substituent having a vinyl group or a cyclic ether group. In this case, vinyl groups or cyclic ether groups can be bonded to each other by polymerization reaction among a plurality of organic silicon compound molecules. If both the condensation and the polymerization are performed, the order of the reactions is not limited. By performing polymerization in addition to condensation, the organic skeleton of a compound obtained by condensation of at least one of the organic silicon compounds represented by General Formulae (1) and (2) is developed, and thus the condensation product can obtain higher alkali resistance (ink resistance). Such conditions are thus preferred. A compound formed by polymerization of a vinyl group moiety or a cyclic ether group moiety is also preferred because such a compound suppresses the change in hydrophilicity of the image forming surface when the intermediate transfer member is repeatedly used.

Specific examples of the monovalent substituent having a vinyl group or a cyclic ether group as $R^2$, $R^6$, $R^{22}$, and $R^{24}$ include an acryloxy group, a methacryloxy group, a glycidoxy group, and a 2-epoxycyclohexyl group.

$R^3$, $R^4$, and $R^{23}$ are a linking chain between a substituted silicon atom and a polyalkylene oxide unit ($X^1$ or $X^3$) and are composed of a divalent group containing an alkylene group, a urethane bond or a carbonyl group. The alkylene group as $R^3$ or $R^4$ may be substituted, and the substituent of the alkylene group can be exemplified by a hydroxy group.

The divalent group containing an alkylene group can be exemplified by alkylene groups, alkyleneoxy groups (-Alk1-O—), alkyleneoxyalkylene groups (-Alk1-O-Alk2-), alkyleneoxyalkyleneoxy groups (-Alk1-O-Alk2-O—), groups formed by linking an alkylene group and an aminocarbonyl group (-Alk3-NH—CO—), and groups formed by linking an alkylene group and a urethane bond group (-Alk4-NH—CO—O—). Each of Alk1 to Alk4 is independently an alkylene group having 1 to 20 carbon atoms which may be substituted.

The divalent group containing a urethane bond group or a carbonyl group can be exemplified by the above-mentioned groups formed by linking an alkylene group and an aminocarbonyl group (-Alk3-NH—O—) and the above-mentioned groups formed by linking an alkylene group and a urethane bond group (-Alk4-NH—CO—O—).

These divalent groups can be appropriately selected depending on the position of an oxygen atom at the terminal of a polyalkylene oxide unit. For example, when the $R^3$ side terminal of $X^1$ bonded to $R^3$ is an oxygen atom (O), an alkylene group or Alk3-NH—CO— can be selected. When the $R^3$ side terminal of $X^1$ bonded to $R^3$ is —$CH_2$—, a divalent group having an oxygen atom that forms a bond with the terminal —$CH_2$— of $X^1$, such as -Alk1-O—, -Alk1-O-Alk2-O—, and -Alk4-NH—CO—O—, can be selected. In the case of $R^4$ and $R^{24}$, the same applies.

In General Formula (1), $R^1$ and $R^5$ are preferably the same substituent, $R^2$ and $R^6$ are preferably the same substituent, $R^3$ and $R^4$ are preferably the same substituent, a and c are preferably the same number, and b and d are preferably the same number.

The monovalent substituent as $R^{24}$ can also be appropriately selected depending on the position of an oxygen atom at the terminal of a polyalkylene oxide unit. For example, when the $R^{24}$ side terminal of a polyoxyalkylene oxide unit is —$CH_2$—, a group having an oxygen atom that forms a bond with the terminal methylene group of the polyoxyalkylene oxide unit, such as a hydroxyl group, an acetyl group as an ester group, and alkyloxy groups, can be selected. When the $R^{24}$ side terminal of a polyoxyalkylene oxide unit is —O—, a hydrogen atom or an alkyl group can be selected, for example. Examples of the organic siloxane compound represented by General Formula (1) and (2) include SIT8192.0, SIH6188, SIB1824.2, SIB1824.84, SIB1824.82 (manufactured by Gelest Inc.), SP-1P-2-006, SP-1P-2-007, and SP-1P-2-013 (manufactured by Specific Polymers Inc.).

By condensation of at least one of the compound of General Formula (1) and the compound of General Formula (2) having the above polyalkylene oxide unit, a resulting compound has siloxane bonds and polyalkylene oxide units in the skeleton thereof.

In the present invention, the number of groups capable of forming a siloxane bond onto the same silicon atom is defined as the number of functional groups per silicon atom of a compound. In other words, each of a, c, and q in General Formulae (1) and (2) represents the number of functional groups per silicon atom. The number of groups capable of forming a siloxane bond in a molecule is defined as the total number of functional groups of a compound. In other words, a+c or q in General Formulae (1) and (2) represents the total number of functional groups. A larger total number of functional groups gives higher crosslinking density after bonding, resulting in lower flexibility. A smaller total number of functional groups results in higher flexibility. On this account, a smaller total number of functional groups is preferred in consideration of only crack resistance. An organic silicon compound having a total number of functional groups of 1 has a terminal of a siloxane skeleton, and thus results in a reduction in crosslinking density, or an improvement in crack resistance, but is unlikely to form an intended skeletal structure to thereby affect coatability and film formability in some cases. Hence, the total number of functional groups of a siloxane skeleton is preferably set in consideration of crack resistance, coating properties, film formability, and the like. In the present invention, $a+c \geq 2$ or $q \geq 2$ is preferred.

In the reaction of an organic silicon compound capable of forming a siloxane bond, the number of siloxane bonds, i.e. the progress degree of condensation, is important. In the present invention, the progress degree of condensation is called degree of condensation, hereinafter.

In the present invention, heating the organic silicon compound in the presence of water allows as-needed hydrolysis and condensation reaction to proceed, thereby performing the condensation reaction. As a result, siloxane bonds are formed. The as-needed hydrolysis and the condensation reaction are appropriately controlled by temperature, time, pH, and other conditions, and an intended degree of condensation can be achieved. An acid catalyst or an alkali catalyst can be used, for example. The progress degree of the condensation reaction (degree of condensation) can be defined by the ratio of the number of condensed functional groups to the number of functional groups capable of condensation, and can be estimated by Si-NMR measurement in practice. For example, for an organic silicon compound having a total number of functional groups of 3, the degree of condensation is calculated by the following method.

T0-body: a silicon atom that forms no bond with any other silicon atom through oxygen.

T1-body: a silicon atom that forms a bond with one silicon atom through oxygen.

T2-body: a silicon atom that forms bonds with two silicon atoms through oxygen.

T3-body: a silicon atom that forms bonds with three silicon atoms through oxygen.

$$\text{Degree of condensation}(\%) = \frac{(T1 + 2 \times T2 + 3 \times T3)}{3 \times (T0 + T1 + T2 + T3)} \times 100$$

For an organic silicon compound having a total number of functional groups of 2, the degree of condensation is calculated by the following method.

D0-body: a silicon atom that forms no bond with any other silicon atom through oxygen.

D1-body: a silicon atom that forms a bond with one silicon atom through oxygen.

D2-body: a silicon atom that forms bonds with two silicon atoms through oxygen.

$$\text{Degree of condensation}(\%) = \frac{(D1 + 2 \times D2)}{2 \times (D0 + D1 + D2)} \times 100$$

The degree of condensation varies depending on the type of an organic silicon compound and synthetic conditions, but an excessively low degree of condensation may affect coating properties and film formability, for example. The degree of condensation is thus preferably 20% or more and more preferably 30% or more.

For hydrolysis reaction, an organometallic compound containing a central metal selected from silicon, titanium, zirconium, and aluminum can be used as a hydrolysis catalyst to control the degree of condensation. Examples of such a catalyst include titanium alkoxides, zirconium alkoxides, aluminum alkoxides, and complexes thereof (such as an acetyl acetonate complex). Such an organometallic compound can be added during the condensation reaction of an organic silicon compound or can be added to the condensation product of an organic silicon compound.

The organic silicon compound of General Formula (1) is preferably a compound of General Formula (1A).

General Formula (1A)

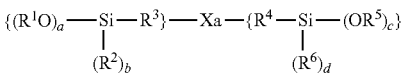

(In the formula, Xa is a polyalkylene oxide unit represented by —(O-Alk)$_n$-O— or —(O-Alk)$_{n'}$—$CH_2C(=CH_2)CH_2$—(O-Alk)$_{n''}$—O— (where Alk is an alkylene group having 2 to 4 carbon atoms; and each of n, n', and n'' is independently an integer of 3 to 50);

each of $R^1$ and $R^5$ is independently an alkyl group having 1 to 4 carbon atoms or a hydrogen atom; each of $R^2$ and $R^6$ is independently an alkyl group having 1 to 4 carbon atoms; each of a and c is independently 2 or 3; each of b and d is independently 0 or 1; a+b=3; c+d=3;

each of $R^3$ and $R^4$ is independently an alkylene group having 1 to 4 carbon atoms, —$(CH_2)_w$—O—$(CH_2CH(OH)CH_2)$—, or —$(CH_2)_w$—NH—CO—; and w is an integer of 1 to 4).

The organic silicon compound of General Formula (2) is preferably a compound of General Formula (2A).

General Formula (2A)

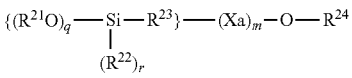

(In the formula, Xa is an alkylene oxide group having 2 to 4 carbon atoms; m is an integer of 3 to 50;

$R^{21}$ is an alkyl group having 1 to 4 carbon atoms or a hydrogen atom;

$R^{22}$ is an alkyl group having 1 to 4 carbon atoms; q is an integer of 2 or 3; r is 0 or 1; q+r=3;

$R^{23}$ is an alkylene group having 1 to 4 carbon atoms or —$(CH_2)_z$—NH—CO—; z is an integer of 1 to 4; and $R^{24}$ is a hydrogen atom, an alkylene group having 1 to 4 carbon atoms, or a methylcarbonyl group)

The alkyl group or the alkylene group in Formulae (1A) and (2A) is preferably a linear group.

Specific examples of the organic silicon compound represented by General Formula (1) more preferably include the following compounds (1-1) to (1-6), and specific examples of the organic silicon compound represented by General Formula (2) include the following compounds (2-1) to (2-5), but the present invention is not limited to them.

(1-1) Bis[(3-methyldimethoxysilyl)propyl]polyethylene oxide (1-2) Bis[(3-methyldimethoxysilyl)propyl]polypropylene oxide (1-3) Bis[3-(triethoxysilylpropoxy)-2-hydroxypropoxy]polyethylene oxide (1-4) Bis[N,N'-(triethoxysilylpropyl)aminocarbonyl]polyethylene oxide (1-5) Bis(triethoxysilylpropyl)polyethylene oxide (1-6) 1,3-[Bis(3-triethoxysilylpropyl)polyethyleneoxy]-2-methylenepropane (2-1) 2-[Acetoxy(polyethyleneoxy)propyl]triethoxysilane (2-2) 2-[Methoxy(polyethyleneoxy)propyl]trimethoxysilane (2-3) Methoxytriethyleneoxypropyltrimethoxysilane (2-4) N-(Triethoxysilylpropyl)-O-polyethylene oxide urethane (2-5) [Hydroxy(polyethyleneoxy)propyl]triethoxysilane One kind of the organic silicon compounds represented by General Formulae (1) and (2) may be condensed or two or more kinds of the organic silicon compounds may be co-condensed. Alternatively, the organic silicon compound may be co-condensed with at least one organic silicon compound that can form a siloxane bond but is neither of the organic silicon compounds of General Formulae (1) and (2). In particular, if the organic silicon compound is co-condensed with another polymerizable organic silicon compound that has a vinyl group or a cyclic ether group and can form a siloxane bond, substantially the same effect as that described above can be achieved in terms of alkaline resistance and maintenance of hydrophilicity, and thus such conditions are preferred.

The other organic silicon compound capable of undergoing co-condensation may be any organic silicon compound that has a hydrolyzable group capable of forming a siloxane bond, is not modified with PAO, and can give an intended condensation product together with at least one of the organic silicon compounds of General Formulae (1) and (2).

The other hydrolyzable organic compound can be exemplified by hydrolyzable organic compounds that have a nonhydrolyzable alkyl group and are not modified with PAO and hydrolyzable organic compounds that have a nonhydrolyzable polymerizable group and are not modified with PAO.

The hydrolyzable silane compound that has a nonhydrolyzable alkyl substituent and is not modified with PAO can be exemplified by compounds of General Formula (3).

General Formula (3): $(R^{30})_t$—Si—$(R^{31})_{(3-t)}$ (In the formula, $R^{30}$ is a nonhydrolyzable alkyl group; $R^{31}$ is a hydrolyzable group; and t is an integer of 0 to 2)

The nonhydrolyzable alkyl group can be exemplified by alkyl groups having 1 to 10 carbon atoms. The hydrolyzable group can be exemplified by alkyloxy groups, and the alkyl group of the alkyloxy group can be exemplified by a methyl group and an ethyl group.

Specific example of the compound of General Formula (3) include the following compounds.

Methyltrimethoxysilane, methyltriethoxysilane, dimethyldimethoxysilane, dimethyldiethoxysilane, trimethylmethoxysilane, trimethylethoxysilane, propyltrimethoxysilane, propyltriethoxysilane, hexyltrimethoxysilane, hexyltriethoxysilane, decyltrimethoxysilane, and decyltriethoxysilane, for example.

Examples of the hydrolyzable silane compound that has a nonhydrolyzable polymerizable group and is not modified with PAO include the following compound of General Formula (4).

General Formula (4)

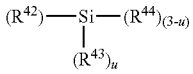

(In the formula, $R^{42}$ is a nonhydrolyzable polymerizable group; $R^{43}$ is a nonhydrolyzable alkyl group; $R^{44}$ is a hydrolyzable group; and u is an integer of 0 to 2)

The nonhydrolyzable polymerizable group can be exemplified by groups having a vinyl group and groups having a cyclic ether group such as an epoxy group and an oxetanyl group.

The nonhydrolyzable alkyl group can be exemplified by alkyl groups having 1 to 10 carbon atoms. The hydrolyzable group can be exemplified by alkyloxy groups, and the alkyl group of the alkyloxy group can be exemplified by a methyl group and an ethyl group.

Specific examples of the compound of General Formula (4) include the following compounds.

Glycidoxypropyltrimethoxysilane, glycidoxypropyltriethoxysilane, glycidoxypropylmethyldimethoxysilane, glycidoxypropylmethyldiethoxysilane, glycidoxypropyldimethylmethoxysilane, glycidoxypropyldimethylethoxysilane, 2-(epoxycyclohexyl)ethyltrimethoxysilane, 2-(epoxycyclohexyl)ethyltriethoxysilane, and compounds prepared by replacing the epoxy group of such a compound with an oxetanyl group, for example.

Acryloxypropyltrimethoxysilane, acryloxypropyltriethoxysilane, acryloxypropylmethyldimethoxysilane, acryloxypropylmethyldiethoxysilane, acryloxypropyldimethylmethoxysilane, acryloxypropyldimethylethoxysilane, methacryloxypropyltrimethoxysilane, methacryloxypropyltriethoxysilane, methacryloxypropylmethyldimethoxysilane, methacryloxypropylmethyldiethoxysilane, methacryloxypropyldimethylmethoxysilane, and methacryloxypropyldimethylethoxysilane, for example.

When at least one compound of General Formulae (3) and (4) is used, the mixing ratio is preferably selected from Compound of General Formula (3):Compound of General Formula (4)=0:100 to 90:10 (molar ratio).

The ratio of at least one of the compounds of General Formulae (3) and (4), (C2), to at least one of the organic silicon compounds of General Formulae (1) and (2), (C1), is preferably selected from C1:C2=1:99 to 20:80 (molar ratio).

In the surface layer part of the intermediate transfer member of the present invention, the content of a condensation product formed by using at least one of the organic silicon compounds represented by General Formulae (1) and (2) varies depending on the type of a polyalkylene oxide and the structures of $R^3$, $R^4$, and the like, but can be 0.1% by mass or more. The surface layer part may be formed of the condensation product alone. When the surface layer part is formed of the condensation product and other materials, the content of the condensation product can be selected from, for example, 0.5% by mass or more to 80% by mass or less, and furthermore from 1% by mass or more to 50% by mass or less.

In the present invention, an ethylene oxide unit is preferably included as the alkylene oxide unit especially from the viewpoint of hydrophilicity. By using the ethylene oxide unit, the hydrophilicity is unlikely to be reduced even if the alkylene oxide unit has a larger carbon number, and thus the number of alkylene oxide units can be increased. Accordingly, a longer chain structure can be introduced, and thus a more flexible intermediate transfer member having excellent transferability can be produced.

In the present invention, a compound prepared by at least condensation of the organic silicon compound of General Formula (1) is preferably included. The reason thereof is supposed as follows: in the case of the organic silicon compound of General Formula (1), functional groups capable of forming a siloxane bond are positioned at both sides of the polyalkylene oxide unit; and thus, a compound prepared by condensation of the organic silicon compound can have a molecular structure in which the polyalkylene oxide unit is introduced between siloxane bonds through covalent bonds, i.e. a molecular structure in which the polyalkylene oxide unit is introduced into the main chain of a siloxane skeleton.

Generally, when a long chain structure is introduced to a side chain, the steric hindrance due to a bulkiness of the side chain partially prevents the main chain from bonding to suppress an excessively high crosslinking density, and thus flexibility can be expressed. However, a moiety prevented from bonding remains as an unreacted moiety and thus may lead to characteristic changes such as a change over time due to long-term storage, a change in orientation due to humidity, and reaction progress due to temperature. On this account, a higher degree of condensation is desired in order to suppress such changes in characteristics. In this case, however, the main chain has a very high crosslinking density, and this reduces the effect of increasing flexibility. In addition, a side chain having a long chain structure has high flexibility in the molecule, and thus surface characteristics may change when the orientation near the surface changes. In contrast, when a long chain structure is introduced to a main chain, the long chain structure is introduced between a bonding point and another bonding point of the main chain. On this account, the bond distance of the main chain can be surely widened even at a high degree of condensation, and a moiety having a low crosslinking density can be maintained. The effect of increasing flexibility is thus sufficiently achieved, and such conditions are preferred. In addition, the both sides of a long chain structure are immobilized, thus the change of orientation near the surface is also suppressed, and a surface layer having more stable characteristics can be obtained accordingly. As described above, it is important for the intermediate transfer member of the present invention to appropriately keep the balance between degree of condensation and crosslinking density. In the present invention, the polyalkylene oxide unit is included as the long chain structure. In particular, in the case of the organic silicon compound of General Formula (1), the long chain structure is introduced to the main chain, and such a structure is preferred. A longer chain structure is likely to be developed, and such a structure is more preferred.

The type of the polyalkylene oxide unit and the total number of functional groups are preferably, appropriately set depending on the types and quantity ratios of other compounds, physical properties of an aggregation liquid and an ink, and process conditions, for example.

In the surface layer part of the intermediate transfer member of the present invention, the ratio of the number of alkylene oxide groups (number of alkylene oxide units) to the number of siloxane bonds is preferably 0.1 to 1.2. By adjusting the ratio within this range, a more sufficient number of alkylene oxide units for making the surface layer part have sufficient flexibility, for preventing generation of cracks and delamination, and for giving good transferability of an intermediate transfer member can be supplied to the surface layer part. In addition, the surface of the surface layer part can be formed as a face having a tackiness more suitable for giving good transferability. If the ratio is less than 0.1, it is difficult to give a surface layer part having sufficient flexibility, and cracks are difficult to effectively suppress in some cases. If the ratio is more than 1.2, the flexibility is improved, and the surface tackiness concurrently increases. This reduces the transferability of an ink aggregate in some cases.

The ratio of the number of alkylene oxide groups to the number of siloxane bonds can be estimated by $^1$H-NMR spectra. As for the $^1$H-NMR, for example, the ratio of a compound having a dimethylsiloxane component and a polyethylene oxide unit can be expressed by the ratio of the peak intensity of an ethylene oxide group (—$CH_2$—$CH_2$—O—, $\sigma$=3.5 to 4.5 ppm) and the peak intensity of the terminal structure of a siloxane bond (—O—Si—$CH_3$, $\sigma$=0.0 to 0.2) as described above.

The surface layer part of the intermediate transfer member in the present invention preferably contains a compound prepared by condensation of the organic silicon compound as described above, and the compound is also preferably polymerized at a polymerizable group moiety thereof such as a vinyl group or a cyclic ether group.

The polymerization initiator used when cationic polymerization is performed as polymerization can be exemplified by photocationic polymerization initiators that generate a cationic species or a Bronsted acid by photoirradiation and thermal cationic polymerization initiators that generate a cationic species or a Bronsted acid by heat.

Specific examples of the cationic initiator include onium salts, borate salts, triazine compounds, azo compounds, and peroxides. Aromatic sulfonium salts and aromatic iodonium salts are preferably used in terms of sensitivity, stability, reactivity, and solubility. The cationic polymerization initiators can be used singly or in combination of two or more of them.

As the polymerization initiator used when radical polymerization is performed as polymerization, a photoradical polymerization initiator that generates a radical species by photoirradiation or a thermal radical initiator that generates a radical species by heat can be used. Examples of the radical polymerization initiator include organic peroxides such as dialkyl peroxides, diacyl peroxides, ketone peroxides, peroxyketals, hydroperoxides, and peroxyesters; azo compounds; carbonyl compounds such as benzophenone and benzophenone compounds, acetophenone compounds, benzoin and benzoin ether compounds, aminocarbonyl compounds, and thioxanthones; sulfides; and peroxides. The radical polymerization initiators can be used singly or in combination of two or more of them.

When at least the organic silicon compound having a polymerizable group is used to form a condensation product, a cationic polymerizable resin and/or a radical polymerizable resin can be used as the other material that contains no Si and is usable to form the surface layer part in combination with the condensation product.

The cationic polymerizable resin as the material containing no Si is a resin containing a compound having a cationic polymerizable group such as a vinyl group and a cyclic ether group. Specifically, resins having an epoxy group or an oxetanyl group are preferably used. If an oxetane compound or an oxetane resin is used in combination with an epoxy resin, curing reaction is accelerated. Specific examples of the epoxy resin include bisphenol epoxy resins prepared from a monomer or an oligomer having a bisphenol skeleton, such as bisphenol-A-diglycidyl ether and bisphenol-F-diglycidyl ether; phenol novolac epoxy resins, cresol novolac epoxy resins, and trisphenolmethane epoxy resins; and resins having an alicyclic epoxy structure, such as 3,4-epoxycyclohexenylmethyl-3',4'-epoxycyclohexene carboxylate.

The radical polymerizable resin as the material containing no Si is a resin containing a compound having a radical polymerizable group such as a vinyl group. Specifically, resins having an acryloyl group, a methacryloyl group, or a styryl group are preferably used. Examples of the radical polymerizable resin include polymers of a polymerizable monomer shown below, mixtures of homopolymers of polymerizable monomers, and copolymers of two or more types of polymerizable monomers.

Examples of the (meth)acrylic acid ester monomer include methyl (meth)acrylate, ethyl (meth)acrylate, propyl (meth)acrylate, n-butyl (meth)acrylate, isobutyl (meth)acrylate, and 2-ethylhexyl (meth)acrylate.

Examples of the styrenic monomer include styrene, o-methylstyrene, m-methylstyrene, p-methylstyrene, $\alpha$-methylstyrene, vinylnaphthalene, 2-ethylstyrene, 3-ethylstyrene, and 4-ethylstyrene.

When a cationic polymerizable resin and/or a radical polymerizable resin is contained as the material containing no Si, a resin having a large functional group equivalent or a known resin having a linear skeleton is preferably used in order to impart sufficient flexibility to the surface layer part. The content of such a resin is preferably 5% by mass or more to 50% by mass or less relative to the surface layer part. In addition to structures best suited for a wide variety of recording medium types, image holding properties on the intermediate transfer member, image transfer efficiency to a recording medium at the time of transfer, image qualities of transfer images, and the like, the thickness, hardness, elastic modulus, and other properties of each layer are appropriately set from the viewpoint of durable stability.

To form the surface layer part of the intermediate transfer member by using a polymerizable material, curing by irradiation of active energy rays or thermal curing enables the formation of a thin and uniform surface layer part having excellent mechanical strength. This also results in good transferability. In addition, the adhesiveness to a layer adjacent to the surface layer part is excellent, resulting in excellent durability. As the active energy rays, electron beams, X-rays, and the like can be used, but ultraviolet rays are preferably used from the viewpoint of workability, for example.

When a coating solution is applied to form the surface layer part, the coating solution also preferably contains appropriate additives such as a surfactant and an auxiliary catalyst for accelerating curing in order to improve the coatability. A coating solution containing no solvent may be applied and the whole coating film may be cured.

In the transfer-type ink jet recording method, an ink or an aggregation liquid used as needed typically has a surface energy of 20 mN/m or more to 50 mN/m or less. In the present invention, it is important for the surface design of the intermediate transfer member to moderately satisfy both wettability and transferability in order to appropriately apply each liquid onto the surface of the intermediate transfer member.

In order to form a good intermediate image on the image forming surface on the surface layer part of the intermediate transfer member and to improve the holding properties of an intermediate image on the intermediate transfer member, the image forming surface preferably has an average surface roughness Ra of 0.001 μm or more to 3.00 μm or less.

Transfer-Type Image Recording Apparatus (Transfer-Type Ink Jet Recording Apparatus)

Figure 2:
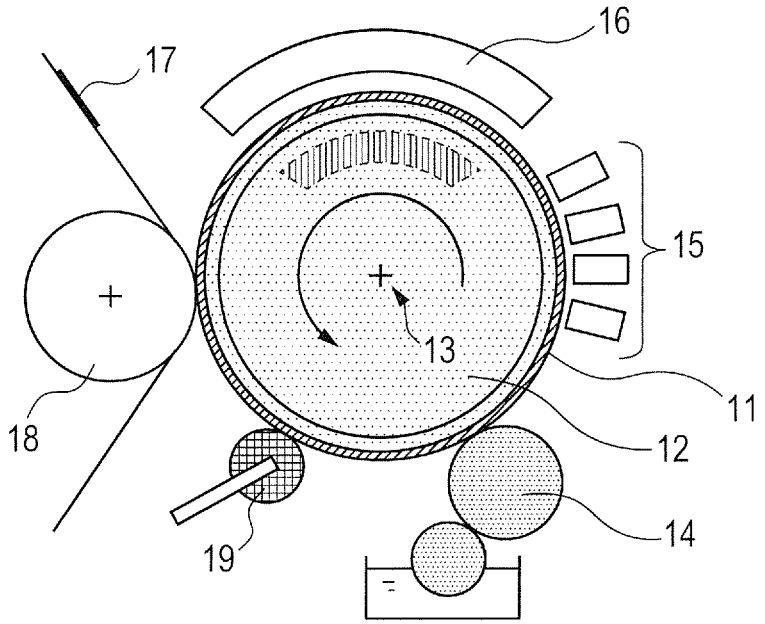
FIG. 2 is a schematic view of the structure of an ink jet recording apparatus usable in a transfer-type image recording method of the present invention.

An embodiment of the transfer-type image recording apparatus (transfer-type ink jet recording apparatus) of the present invention is shown in FIG. 2. The apparatus includes an intermediate transfer member 11 having an image forming surface, an ink jet device 15 as an ink applying unit, coating rollers 14 as an aggregation liquid coating unit, and a pressure roller 18. The pressure roller 18 constitutes, together with the intermediate transfer member 11, a transfer unit of an intermediate image. The ink jet device 15 has a structure of ejecting inks from ink jet recording heads.

Transfer-Type Image Recording Method

Image recording (image formation) with the apparatus can be performed by the following operations. To the image forming surface on the intermediate transfer member 11 to which an aggregation liquid has been applied with the coating rollers 14, an ink is applied by using the ink jet device 15 to form an intermediate image. Next, the pressure roller 18 is used to press the intermediate image formed on the intermediate transfer member against a recording medium 17, and the intermediate image is transferred to the recording medium.

The intermediate transfer member of the present invention can be provided on a support member 12. The support member 12 is rotationally driven in the arrow direction around an axis 13 as the center. Each device arranged around the intermediate transfer member works in such a way as to be synchronized with the rotation of the support member. The support member is required to have a certain structural strength from the viewpoint of the transfer accuracy and the durability thereof. As the material of the support member, metals, ceramics, and resins are preferably used, for example. Specifically, the following materials are preferably used in terms of the rigidity capable of withstanding the pressure at the time of transfer, dimensional accuracy, and an improvement of control responsivity by reducing inertia during operation: aluminum, iron, stainless steel, acetal resins, epoxy resins, polyimide, polyethylene, polyethylene terephthalate, nylon, polyurethane, silica ceramics, and alumina ceramics, for example. These materials are also preferably used in combination. As the support member, for example, a roller-type support member and a belt-shaped support member are also preferably used according to the shape of a recording apparatus to be applied or the mode of transfer to a recording medium. When a drum-shaped support member or a belt-shaped endless-web type support member is used, the same intermediate transfer member can be continuously, repeatedly used, and thus such a structure is particularly preferred in terms of productivity.

Each step of the transfer-type image recording method will next be described.

Aggregation Liquid Application Step

To the intermediate transfer member 11, an aggregation liquid is applied preferably before an ink is applied. As the method of applying the aggregation liquid, conventionally known various methods can be appropriately used. Examples of the method include die coating, blade coating, gravure coating, and methods combining such a method with offset roller coating. As the method of capable of application at high speed with high accuracy, an ink jet method is also preferably used.

The aggregation liquid contains a component that increases the viscosity of an ink. Such a component reduces the flowability of at least a part of an ink on an intermediate transfer member, and thus has effects of suppressing spreading and mixing of the ink, i.e. bleeding and beading, for example. In other words, when an image is formed by using an ink jet device, a large amount of an ink may be applied to a unit area. In such a case, bleeding or beading is likely to occur. However, if an aggregation liquid is applied onto an intermediate transfer member, the flowability of an ink is reduced when the ink is used to form an image. Thus, bleeding or beading is unlikely occur, and consequently the image is satisfactory formed and held.

The component for increasing the viscosity of an ink is preferably appropriately selected according to the type of an ink used for forming an image. For example, for dye type inks, an aggregation liquid containing a polymer aggregating agent is preferably used. For pigment type inks in which pigment particles are dispersed, an aggregation liquid containing a polyvalent metal ion or an aggregation liquid containing a pH adjuster such as an acid buffer is preferably used. As an example of other ink viscosity increasing components, a compound having a plurality of ionic groups, such as a cation polymer, is also preferably used. Combination use of two or more of these compounds is also effective. Specific examples of the polymer aggregating agent usable as the ink viscosity increasing component include cationic polymer aggregating agents, anionic polymer aggregating agents, nonionic polymer aggregating agents, and amphoteric polymer aggregating agents.

Examples of the metal ion used as the component for increasing the viscosity of an ink include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$. If the aggregation liquid containing such a metal ion is applied, the aggregation liquid is preferably applied as an aqueous metal salt solution. Examples of the anion of the metal salt include, but are not necessarily limited to, Cl, $NO_3$, $CO_3^{2}$, $SO_4^{2}$, I, Br, $ClO_3$, HCOO, and $RCOO^-$ (R is an alkyl group). The aqueous metal salt solution preferably has a metal salt concentration of 0.01% by mass or more, and more preferably 0.1% by mass or more. The metal salt concentration is preferably 20% by mass or less.

As the pH adjuster used as the component for increasing the viscosity of an ink, an acidic solution having a pH of less than 7.0 is preferably used. Examples include inorganic acids such as hydrochloric acid, phosphoric acid, sulfuric acid, nitric acid, and boric acid; and organic acids such as oxalic acid, polyacrylic acid, acetic acid, glycolic acid, malonic acid, malic acid, maleic acid, ascorbic acid, succinic acid, glutaric acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, and nicotinic acid. A solution of a derivative of such a compound or a solution of a salt of such a compound can also be preferably used.

An acid buffer having a pH buffering capacity is preferably used because the change in pH is small even when the apparent concentration of an aggregation liquid is reduced by an ink and the reactivity with an ink is unlikely reduced. To obtain the pH buffer capacity, the aggregation liquid preferably contains a buffer agent. As the buffer agent, an acetate such as sodium acetate, potassium acetate, and lithium acetate, a hydrogen phosphate, a hydrogen carbonate, or a hydrogen salt of a polyvalent carboxylic acid, such as sodium hydrogen phthalate and potassium hydrogen phthalate can be used, for example. Examples of the polyvalent carboxylic acid include, in addition to the phthalic acid, malonic acid, maleic acid, succinic acid, fumaric acid, itaconic acid, phthalic acid, isophthalic acid, terephthalic acid, adipic acid, sebacic acid, dimer acid, pyromellitic acid, and trimellitic acid. In addition to the above, any known compound which exhibits a pH buffering action when added can be preferably used.

The aggregation liquid may be prepared by dissolving a component that increases the viscosity of an ink as described above in an aqueous medium. Examples of the aqueous medium include water and mixed solvents of water and a water-soluble organic solvent. In the aggregation liquid, the content of the aqueous medium is not limited to particular values, and can be set according to the type of an active component for aggregation in the aggregation liquid, a coating method, and the type of a recording medium, for example.

As the water-soluble organic solvent, the following solvents are specifically preferably used: alkanediols such as 1,3-butanediol, 1,5-pentanediol, 1,2-hexanediol, and 1,6-hexanediol; glycol ethers such as diethylene glycol monomethyl (or monoethyl) ether and triethylene glycol monoethyl (or monobutyl) ether; alkyl alcohols having 1 to 4 carbon atoms, such as ethanol, isopropanol, n-butanol, isobutanol, sec-butanol, and tert-butanol; carboxylic acid amides such as N,N-dimethylformamide and N,N-dimethylacetamide; ketones and keto alcohols, such as acetone, methyl ethyl ketone, and 2-methyl-2-hydroxypentan-4-one; cyclic ethers such as tetrahydrofuran and dioxane; glycerol; alkylene glycols such as ethylene glycol, diethylene glycol, triethylene glycol, tetraethylene glycol, 1,2- or 1,3-propylene glycol, 1,2- or 1,4-butylene glycol, and polyethylene glycol; polyhydric alcohols such as thiodiglycol, 1,2,6-hexanetriol, and acetylene glycol derivatives; sulfur-containing compounds such as 2-pyrrolidone, N-methyl-2-pyrrolidone, 1,3-dimethyl-2-imidazolidinone, and dimethyl sulfoxide. From these compounds, two or more compounds can be also preferably selected and used as a mixture. The aggregation liquid can appropriately contain an antifoaming agent, an antiseptic agent, an antifungal agent, and other additives as needed in addition to the above components in order to obtain desired properties.

To the aggregation liquid, various resins can also be added in order to improve the transferability or to improve the toughness of an image finally formed. By adding a resin, the adhesiveness to a recording medium at the time of transfer can be increased, or the mechanical strength of an intermediate image can be increased. Depending on the type of a resin, the water resistance of a final image on a recording medium can be improved. The resin to be added may be any resin that can be present together with the ink viscosity increasing component. As an example, an organic polymer such as polyvinyl alcohol and polyvinylpyrrolidone is preferably used. A resin that reacts with a component contained in an ink to form crosslinkage is also preferred. Such a resin can be exemplified by polyoxazolines and polycarbodiimides that react with a carboxylic acid generally used for dispersion of a coloring material in an ink to form crosslinkage. Such a resin can be dissolved in a solvent of the aggregation liquid or can be added in an emulsion form or a suspension form. To the aggregation liquid, a surfactant may also be added to appropriately control the surface tension.

The aggregation liquid may be applied before the formation of an intermediate image and/or after the formation of an intermediate image. FIG. 2 shows an example in which the aggregation liquid is applied before the formation of an intermediate image.

Intermediate Image Forming Step

To the image forming surface of the intermediate transfer member 11 to which the aggregation liquid has been applied, an ink is applied by using the ink jet device 15. The ink ejection system of the ink jet device include a system in which film boiling of an ink is caused by an electrothermal converter to form bubbles and ejects the ink, a system in which an ink is ejected by an electromechanical converter, and a system in which an ink is ejected by using static electricity, for example. From the viewpoint of high-density printing at high speed, the system using an electrothermal converter is preferably used.

The whole shape of the ink jet device is not limited to particular shapes. The shape of the recording head is not also limited to particular shapes, and either a line-head type head in which ink ejection orifices are arranged in a linear manner in the width direction of the image forming surface of the intermediate transfer member or a shuttle type head that conducts scanning in a predetermined direction on the image forming surface to apply an ink can be preferably used.

As the ink, inks widely used as the ink jet ink can be used. Specifically, various inks prepared by dissolving and/or dispersing a coloring material such as a dye, carbon black, and an organic pigment can be used. Of them, carbon black and organic pigment inks give an image having good weatherability or good color developability and thus are preferred.

As the ink, an aqueous ink containing water is preferred. In particular, an ink containing water in an amount of 45.0% by mass or more in the components is preferred. The content of the coloring material in the ink is preferably 0.1% by mass or more, and more preferably 0.2% by mass or more. The content is preferably 15.0% by mass or less, and more preferably 10.0% by mass or less.

The ink can contain a dye and/or a pigment as the coloring material and a polymer compound and a resin component as the dispersant for a pigment added as needed. As the coloring material, such conventional coloring materials as disclosed in Japanese Patent Application Laid-Open No. 2008-018719 can be used.

In order to improve the toughness and the like of an image finally formed on a recording medium, the ink can contain resin components such as water-soluble resins and water-soluble crosslinking agents. The material to be used may be any material that can be present together with ink components.

When an aqueous ink containing a water-soluble organic solvent is used, volatile components such as water are removed from the ink forming an intermediate image when being transferred to a recording medium, and thus such an intermediate image is formed mainly from a coloring material component and a water-soluble organic solvent. When the ink forming an intermediate image contains a water-soluble organic solvent at the time of transfer of the intermediate image to a recording medium, the ink is more satisfactory released from the image forming surface of the intermediate transfer member, and thus the transferability of the intermediate image can be improved. To achieve the effect of improving the transferability, a water-soluble organic solvent having a high boiling point and a low vapor pressure is preferred. Such a water-soluble organic solvent can be exemplified by the following water-soluble organic solvents: alkanediols such as 1,3-butanediol, 1,5-pentanediol, 1,2-hexanediol, and 1,6-hexanediol; glycol ethers such as diethylene glycol monomethyl (or monoethyl) ether and triethylene glycol monoethyl (or monobutyl) ether; alkyl alcohols having 1 to 4 carbon atoms, such as ethanol, isopropanol, n-butanol, isobutanol, sec-butanol, and tert-butanol; carboxylic acid amides such as N,N-dimethylformamide and N,N-dimethylacetamide; ketones and keto alcohols, such as acetone, methyl ethyl ketone, and 2-methyl-2-hydroxypentan-4-one; cyclic ethers such as tetrahydrofuran and dioxane; glycerol; alkylene glycols such as ethylene glycol, diethylene glycol, triethylene glycol, tetraethylene glycol, 1,2- or 1,3-propylene glycol, 1,2- or 1,4-butylene glycol, and polyethylene glycol; polyhydric alcohols such as thiodiglycol and 1,2,6-hexanetriol; heterocycles such as 2-pyrrolidone, N-methyl-2-pyrrolidone, 1,3-dimethyl-2-imidazolidinone, and N-methylmorpholine; and sulfur-containing compounds such as dimethyl sulfoxide.

From these compounds, two or more compounds can also be selected and used as a mixture.

If such a water-soluble organic solvent having a high boiling point and a low vapor pressure is used, the content of the solvent in the ink is preferably selected from a range up to 30% by mass.

The ink may contain various additives such as a pH adjuster, an anticorrosive, an antiseptic agent, an antifungal agent, an antioxidant, a reduction inhibitor, a neutralizer for water-soluble resins, and a salt, as needed. A surfactant may be added as needed to appropriately adjust the surface tension of an ink. The surfactant may be any surfactant that does no greatly affect the storage stability or the like of an ink. Examples of the surfactant include anionic surfactants such as fatty acid salts, higher alcohol sulfuric acid ester salts, liquid fatty oil sulfuric acid ester salts, and alkyl allyl sulfonic acid salts; and nonionic surfactants such as polyoxyethylene alkyl esters, polyoxyethylene sorbitan alkyl esters, acetylene alcohols, and acetylene glycols. Two or more of these surfactants can also be appropriately selected and used.

The mixing ratio of components constituting the ink can be appropriately adjusted so that a resulting ink can be ejected in consideration of the ejection capacity, the nozzle diameter, and the like of a selected ink jet head.

Drying Step

In FIG. 2, a heater 16 is used to reduce a liquid content from an intermediate image. If the liquid content in an intermediate image is excess, the excess liquid may extrude or overflow in the subsequent transfer step. This may deteriorate an intermediate image or reduce the transferability. As the method of reducing the liquid content, any of conventional various methods can be preferably used. Examples of the method include a heating method, a method of sending low-humidity air, a decompression method, a method of bringing an absorber that absorbs liquid into contact, and combination methods of them. The drying can also be performed by air drying.

Transfer Step

After the drying step, by pressing an intermediate image against a recording medium, the intermediate image is transferred from the image forming surface of the intermediate transfer member to the recording medium, giving a printed product on which a final image is recorded. The recording medium includes not only plain papers and glossy papers used in common printing but also a wide variety of other printing media such as fabrics, plastics, and films, for example. During the pressing, a pressure roller 18 is preferably used to press an intermediate image from both of the intermediate transfer member side and the recording medium side because the intermediate image is efficiently transferred and formed. Pressing in multiple steps is also preferred because good transferability is achieved.

Washing Step

The intermediate transfer member 11 is repeatedly, continuously used in some cases from the viewpoint of productivity. In such a case, the surface is preferably washed and restored with a washing roller 19 or the like before the next image is formed. As the method of washing and restoring the surface, any of conventional various methods can be preferably used. Examples of the method include a method of applying a shower of a cleaning liquid, a method of bringing a wet molton roller into contact with the surface and wiping the surface, a method of bringing the intermediate transfer member surface into contact with the surface of a cleaning liquid, a method of scraping a residue by using a wiper blade, and a method of applying various energies. These methods may be used in combination.

EXAMPLES

Examples and comparative examples of the present invention will be described hereinafter.

Examples 1 to 17, Comparative Examples 1 and 2

Intermediate transfer members for transfer-type ink jet recording used as examples and comparative examples in the present invention were prepared by the following method.

First, each condensation product was synthesized by the following procedure.

In Examples 1, 2, 4, 9, and 13 and Comparative Example 2, compounds for constituent unit A and constituent unit B were mixed so as to give the molar composition of a condensation product shown in Table 1, giving a material for producing a hydrolysis-condensation product. In Examples 3, 5 to 8, 10 to 12, and 14 to 17, compounds for constituent unit A, constituent unit B, and constituent unit C were mixed so as to give the molar composition of a condensation product shown in Table 1, giving a material for producing a hydrolysis-condensation product. In Comparative Example 1, only a compound for constituent unit B was used, giving a material for producing a hydrolysis-condensation product. Each material was heated and refluxed in a water solvent together with hydrochloric acid as a catalyst for 24 hours or more to conduct hydrolytic condensation, giving a solution containing a condensation product.

Next, each solution containing the resulting condensation product was diluted to 15% by mass with methyl isobutyl ketone, and a photocationic polymerization initiator (trade name: SP150, manufactured by ADEKA) was added at 5% by mass relative to the total solid content. In this manner, a coating solution for forming a surface layer part was obtained.

Next, the main body of an intermediate transfer member was prepared by coating a polyethylene terephthalate (PET) film having a thickness of 0.05 mm with a silicone rubber having a rubber hardness of 40 degree and a thickness of 0.2 mm. To the main body, each solution containing the hydrolysis-condensation product was applied by spin coating to form a film, thereby providing a surface layer on the main body as the base layer. After the surface layer was provided, an UV lamp was used to perform irradiation and exposure. The surface layer was then heated at 120° C. for 2 hours to be cured, and a surface layer part constituting the image forming surface was formed, giving each intermediate transfer member.

The surface layer part prepared in this manner had a thickness of 1.0 μm in each intermediate transfer member.

The ratio of the number of alkylene oxide groups and the number of siloxane bonds in the skeleton of the surface layer part was determined by the following method.

Each intermediate transfer member was immersed in 2-methyl-diethyl ketone for 12 hours and then was dried. The surface layer part was released to prepare a sample for measurement. The ratio of the peak intensity of an ethylene oxide group (—$CH_2$—$CH_2$—O—, σ=3.5 to 4.5 ppm) and the peak intensity of the terminal structure of a siloxane bond (—O—Si—$CH_3$, σ=0.0 to 0.2) of each measurement sample was determined by solid $^1$H-NMR (AV400M manufactured by Bruker). From each intensity ratio obtained, the ratio of the number of alkylene oxide groups and the number of siloxane bonds in the skeleton of the surface layer part was calculated.

Evaluation

Each intermediate transfer member was evaluated by using the transfer-type ink jet recording apparatus shown in FIG. 2. As the support member of each intermediate transfer member, a cylindrical drum made of aluminum alloy was used.

First, to a 13% by mass aqueous solution of calcium chloride ($CaCl_2.2H_2O$), a surfactant and additives were appropriately added to adjust the surface tension and the viscosity, giving an aggregation liquid. The obtained aggregation liquid was continuously applied to the surface (image forming surface) of the intermediate transfer member by using a roller type coating apparatus. Next, an ink for forming images were ejected from an ink jet device to the image forming surface of the intermediate transfer member to form an intermediate image (mirror-inverted image) on the intermediate transfer member. As the ink jet device, a device including an electrothermal converter for ejecting an ink on demand was used. As the ink, a resin dispersion type pigment ink having the following formulation was used.

C.I. Pigment Blue 15: 3.0 parts by mass

Styrene-acrylic acid-ethyl acrylate copolymer (an acid value of 240, a weight average molecular weight of 5,000): 1.0 part by mass Glycerol: 10.0 parts by mass Ethylene glycol: 5.0 parts by mass Acetylenol E100 (trade name): 0.5 part by mass Ion-exchanged water: 80.5 parts by mass Next, a long rolled PET film with a hydrophilized surface (a thickness of 150 μm) was used as the recording medium, and the intermediate image formed by the above method was pressed against the recording medium, giving a final image. After the transfer of the intermediate image, the image forming surface was restored by washing. The formation and transfer of intermediate images were continuously repeated 50,000 times, and the following evaluations were performed.

Aggregation Liquid Coatability

Before and after the transfer was repeated 50,000 times on an intermediate transfer member, the uniformity of the aggregation liquid applied to the intermediate transfer member surface was visually evaluated based on the following criteria.

A: The aggregation liquid is uniformly applied to the intermediate transfer member surface.

B: The aggregation liquid is almost uniformly applied to the intermediate transfer member surface.

C: The aggregation liquid is not uniformly applied to the intermediate transfer member surface.

Crack Resistance

After the transfer was repeated 50,000 times, the crack resistance of the surface layer part of an intermediate transfer member was visually evaluated based on the following criteria.

AA: No crack is observed on the surface layer part even after the transfer is repeated 50,000 times.

A: No crack is observed on the surface layer part after the transfer is repeated 30,000 times, but cracks are observed on the surface layer part after the transfer is repeated 50,000 times.

B: No crack is observed on the surface layer part after the transfer is repeated 20,000 times, but cracks are observed on the surface layer part after the transfer is repeated 30,000 times.

C: No crack is observed on the surface layer part after the transfer is repeated 10,000 times, but cracks are observed on the surface layer part after the transfer is repeated 20,000 times.

D: Cracks are observed on the surface layer part after the transfer is repeated 10,000 times.

The evaluation results are shown in Table 1.

TABLE 1

| | Constituent unit A | | | | Constituent unit B | | Constituent unit C | | Ratio of number of alkyl oxide groups/number of siloxane bonds | Aggregation liquid coatability | |
|---|---|---|---|---|---|---|---|---|---|---|---|
| | Compound | N | c | Content [mol %] | Compound | Content [mol %] | Compound | Content [mol %] | | Initial state → after transfer | Crack resistance |
| Example 1 | I | 4 to 6 | 1 | 20 | MTES | 80 | — | | 0.33 | A→A | A |
| Example 2 | II | 8 to 12 | 1 | 20 | MTES | 80 | — | | 0.53 | A→A | A |
| Example 3 | II | 8 to 12 | 1 | 5 | MTES | 65 | GPMDES | 30 | 0.15 | A→A | A |
| Example 4 | III | 5 to 8 | 2 | 5 | MTES | 95 | — | | 0.13 | A→A | AA |
| Example 5 | III | 5 to 8 | 2 | 5 | MTES | 65 | GPMDES | 30 | 0.14 | A→A | A |

TABLE 1-continued

| | Constituent unit A | | | | Constituent unit B | | Constituent unit C | | Ratio of number of alkyl oxide groups/number | Aggregation liquid coatability | |
|---|---|---|---|---|---|---|---|---|---|---|---|
| | Compound | N | c | Content [mol %] | Compound | Content [mol %] | Compound | Content [mol %] | of siloxane bonds | Initial state → after transfer | Crack resistance |
| Example 6 | IV | 25 to 30 | 2 | 3 | MTES | 65 | GPMDES | 32 | 0.25 | A→A | AA |
| Example 7 | IV | 25 to 30 | 2 | 10 | MTES | 60 | GPMDES | 30 | 0.77 | A→A | AA |
| Example 8 | V | 10 to 15 | 2 | 3 | MTES | 65 | GPMDES | 32 | 0.14 | A→A | AA |
| Example 9 | IV | 25 to 30 | 2 | 1 | MTES | 99 | — | | 0.08 | A→A | B |
| Example 10 | IV | 25 to 30 | 2 | 20 | MTES | 50 | GPMDES | 30 | 1.39 | B→B | AA |
| Example 11 | IV | 25 to 30 | 2 | 3 | DMDES | 65 | GPMDES | 32 | 0.33 | A→A | AA |
| Example 12 | IV | 25 to 30 | 2 | 3 | MTES | 65 | GPTES | 32 | 0.23 | A→A | AA |
| Example 13 | I | 4 to 6 | 1 | 20 | MTES | 80 | — | | 0.02 | A→B | C |
| Example 14 | IV | 25 to 30 | 2 | 3 | DMDES | 48.5 | GPMDES | 48.5 | 0.36 | A→A | AA |
| Example 15 | IV | 25 to 30 | 2 | 10 | DMDES | 45 | GPMDES | 45 | 1.28 | B→B | AA |
| Example 16 | IV | 25 to 30 | 2 | 3 | DMDES | 90 | GPMDES | 7 | 0.36 | A→A | AA |
| Example 17 | IV | 25 to 30 | 2 | 3 | DMDES | 7 | GPMDES | 90 | 0.36 | A→A | A |
| Comparative Example 1 | — | — | — | — | MTES | 100 | — | — | — | A→A | D |
| Comparative Example 2 | VI | — | — | 20 | MTES | 80 | — | — | — | C→C | B |

The compound names in Table 1 are abbreviations of the following compounds.

Compounds for Constituent Unit A

I: N-(Triethoxysilylpropyl)-O-polyethylene oxide urethane (SIT 8192.0 (manufactured by Gelest Inc.))

II: [Hydroxy(polyethyleneoxy)propyl]triethoxysilane (SIH6188 (manufactured by Gelest Inc.))

III: Bis[3-(triethoxysilylpropoxy)-2-hydroxypropoxy]polyethylene oxide (SIB1824.2 (manufactured by Gelest Inc.))

IV: Bis(triethoxysilylpropyl)polyethylene oxide (SIB1824.84 (manufactured by Gelest Inc.))

V: Bis[N,N'-(triethoxysilylpropyl)aminocarbonyl]polyethylene oxide (SIB1824.82 (manufactured by Gelest Inc.))

VI: Decyltrimethoxysilane

Compounds for Constituent Unit B

MTES: Methyltriethoxysilane

DMDES: Dimethyldiethoxysilane

Compounds for Constituent Unit C

GPTES: Glycidoxypropyltriethoxysilane

GPMDES: Glycidoxypropylmethyldiethoxysilane

Tables 2 and 3 show the structural formulae of the organic silicon compounds used as the compounds for constituent unit A

TABLE 2

| Compound | General formula | $X^1$ | $R^1$, $R^5$ | $R^2$, $R^6$ | $R^3$ | $R^4$ | a | b | c | d |
|---|---|---|---|---|---|---|---|---|---|---|
| III | (1) | $-(C_2H_4O)_{3-8}-$ | $C_2H_5-$ | — | $-C_3H_6-O-CH_2-CH(OH)-CH_2-O-$ | $-CH_2-CH(OH)-CH_2-O-C_3H_6-$ | 3 | 0 | 3 | 0 |
| IV | (1) | $-(C_2H_4O)_{25-30}-$ | $C_2H_5-$ | — | $-C_3H_6-$ | $-C_3H_6-$ | 3 | 0 | 3 | 0 |
| V | (1) | $-(C_2H_4O)_{10-15}-$ | $C_2H_5-$ | — | $-C_3H_6-N(H)-C(=O)-O-$ | $-C(=O)-N(H)-C_3H_6-$ | 3 | 0 | 3 | 0 |

TABLE 3

| Compound | General formula | $X^3$ | $R^{21}$ | $R^{22}$ | $R^{23}$ | $R^{24}$ | q | r |
|---|---|---|---|---|---|---|---|---|
| I | (2) | $-(C_2H_4O)_{4-6}-$ | $C_2H_5-$ | — | $-C_3H_6-N(H)-C(=O)-O-$ | —H | 3 | 0 |
| II | (2) | $-(C_2H_4O)_{8-12}-$ | $C_2H_5-$ | — | $-C_3H_6-$ | —OH | 3 | 0 |
| VI | $(CH_3O)_3-Si-C_9H_{18}-CH_3$ | | | | | | | |

As shown in Table 1, the intermediate transfer members of Examples 1 to 17 each including a surface layer part composed of the compound having a siloxane bond and a polyalkylene oxide unit in the skeleton exhibited good aggregation liquid coatability in the initial state and after repeated transfer, and the change of the coatability was small.

In these examples, no crack was generated until the transfer was repeated 10,000 times, and there was no difference in image qualities of the obtained images in the initial state and after repeated transfer. In Examples 1 to 12 and 14 to 17 in which the ratio, number of alkyl oxide groups/number of siloxane bonds, was within the particular range, the results indicated higher effects of suppressing the crack generation.

In contrast, the intermediate transfer member of Comparative Example 1 that did not include a surface layer part composed of the compound having a siloxane bond and a polyalkylene oxide unit in the skeleton gave images that had a difference in image qualities in the initial state and after repeated transfer, and stable image recording was difficult. The intermediate transfer member of Comparative Example 2 repelled the aggregation liquid on the surface, and was consequently unlikely to achieve an even coating state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-148505, filed Jul. 28, 2015, which is hereby incorporated by reference herein in its entirety.

What is claimed is:

1. An intermediate transfer member for use in a transfer-type image recording method including applying an ink to the intermediate transfer member to form an intermediate image and transferring the intermediate image to a recording medium, wherein a surface layer part of the intermediate transfer member comprises an organic siloxane compound having a siloxane bond and a polyalkylene oxide unit.

2. The intermediate transfer member according to claim 1, wherein the organic siloxane compound is a condensation product of at least one hydrolyzable siloxane compound, and the at least one hydrolyzable siloxane compound includes at least one organic silicon compound represented by general formula (1) or (2):

$$\{(R^1O)_a-\underset{\underset{(R^2)_b}{|}}{Si}-R^3\}-X^1-\{R^4-\underset{\underset{(R^6)_d}{|}}{Si}-(OR^5)_c\}, \quad (1)$$

where $X^1$ is a polyalkylene oxide unit containing $(X^2)_n$; $X^2$ is an alkylene oxide group having 2 to 4 carbon atoms; n is an integer of 3 to 50; each of $R^1$ and $R^5$ is independently a hydrogen atom or an alkyl group having 1 to 4 carbon atoms; each of $R^2$ and $R^6$ is independently a monovalent group having an alkyl group having 1 to 20 carbon atoms, a hydroxyl group, a carboxyl group, a vinyl group or a cyclic ether group; each of a and c is independently an integer of 1 to 3; each of b and d is independently an integer of 0 to 2; a+b=3; c+d=3; and each of $R^3$ and $R^4$ is independently a divalent group containing an alkylene group having 1 to 20 carbon atoms, a urethane bond or a carbonyl group;

$$\{(R^{21}O)_q-\underset{\underset{(R^{22})_r}{|}}{Si}-R^{23}\}-X^3-R^{24}, \quad (2)$$

where $X^3$ is a polyalkylene oxide unit containing $(X^4)_m$; $X^4$ is an alkylene oxide group having 2 to 4 carbon atoms; m is an integer of 3 or 50; $R^{21}$ is an alkyl group having 1 to 4 carbon atoms or a hydrogen atom; $R^{22}$ is a monovalent group having an alkyl group having 1 to 20 carbon atoms, a hydroxyl group, a carboxyl group, a vinyl group or a cyclic ether group, q is an integer of 1 to 3; r is an integer of 0 to 2; q+r=3; $R^{23}$ is a divalent group containing an alkylene group having 1 to 20 carbon atoms, a urethane bond or a carbonyl group; and $R^{24}$ is a monovalent group having a hydrogen atom, an alkyl group having 1 to 20 carbon atoms, a hydroxyl group, a carboxyl group, an ester group, a vinyl group or a cyclic ether group.

3. The intermediate transfer member according to claim 2, wherein the condensation product has a ratio of a number of alkylene oxide units to a number of siloxane bonds of 0.1 to 1.2.

4. The intermediate transfer member according to claim 2, wherein the at least one hydrolyzable siloxane compound comprises:

the at least one organic silicon compound represented by the general formula (1) or (2); and at least one hydrolyzable siloxane compound represented by general formula (3) or (4):

$$(R^{30})_t\text{-}Si\text{-}(R^{31})_{(3-t)} \quad (3),$$

where $R^{30}$ is a nonhydrolyzable alkyl group; $R^{31}$ is a hydrolyzable group; and t is an integer of 0 to 2;

$$(R^{42})-\underset{\underset{(R^{43})_u}{|}}{Si}-(R^{44})_{(3-u)}, \quad (4)$$

where $R^{42}$ is a nonhydrolyzable polymerizable group; $R^{43}$ is a nonhydrolyzable alkyl group; $R^{44}$ is a hydrolyzable group; and u is an integer of 0 to 2.

5. The intermediate transfer member according to claim 4, wherein the nonhydrolyzable polymerizable group is a vinyl group or a cyclic ether group.

6. The intermediate transfer member according to claim 1, wherein the polyalkylene oxide unit is a polyethylene oxide unit.

7. The intermediate transfer member according to claim 1, wherein a thickness of the surface layer part is 0.1 μm to 10.0 μm.

8. A transfer-type image recording method comprising:

applying an ink to an intermediate transfer member to form an intermediate image; and transferring the intermediate image to a recording medium, wherein a surface layer part of the intermediate transfer member contains an organic siloxane compound having a siloxane bond and a polyalkylene oxide unit.

9. The transfer-type image recording method according to claim 8, wherein the applying of the ink to the intermediate transfer member is performed by an ink jet method.

10. The intermediate transfer member according to claim 1, wherein the polyalkylene oxide unit has 6 to 100 carbon atoms.

11. The transfer-type image recording method according to claim 8, further comprising applying an aggregation liquid to the intermediate transfer member before the applying of the ink.

12. The transfer-type image recording method according to claim 11, wherein the aggregation liquid contains a polyvalent metal ion or a pH adjuster.

13. The transfer-type image recording method according to claim 8, wherein the organic siloxane compound is a condensation product of at least one hydrolyzable siloxane compound, and the at least one hydrolyzable siloxane compound includes at least one organic silicon compound represented by general formula (1) or (2):

$$\{(R^1O)_a-\underset{\underset{(R^2)_b}{|}}{Si}-R^3\}-X^1-\{R^4-\underset{\underset{(R^6)_d}{|}}{Si}-(OR^5)_c\}, \quad (1)$$

where $X^1$ is a polyalkylene oxide unit containing $(X^2)_n$; $X^2$ is an alkylene oxide group having 2 to 4 carbon atoms; n is an integer of 3 to 50; each of $R^1$ and $R^5$ is independently a hydrogen atom or an alkyl group having 1 to 4 carbon atoms; each of $R^2$ and $R^6$ is independently a monovalent group having an alkyl group having 1 to 20 carbon atoms, a hydroxyl group, a carboxyl group, a vinyl group or a cyclic ether group; each of a and c is independently an integer of 1 to 3; each of b and d is independently an integer of 0 to 2; a+b=3; c+d=3; and each of $R^3$ and $R^4$ is independently a divalent group containing an alkylene group having 1 to 20 carbon atoms, a urethane bond or a carbonyl group;

$$\{(R^{21}O)_q-\underset{\underset{(R^{22})_r}{|}}{Si}-R^{23}\}-X^3-R^{24}, \quad (2)$$

where $X^3$ is a polyalkylene oxide unit containing $(X^4)_m$; $X^4$ is an alkylene oxide group having 2 to 4 carbon atoms; m is an integer of 3 to 50; $R^{21}$ is an alkyl group having 1 to 4 carbon atoms or a hydrogen atom; $R^{22}$ is a monovalent group having an alkyl group having 1 to 20 carbon atoms, a hydroxyl group, a carboxyl group, a vinyl group or a cyclic ether group; q is an integer of 1 to 3; r is an integer of 0 to 2; q+r=3; $R^{23}$ is a divalent group containing an alkylene group having 1 to 20 carbon atoms, a urethane bond or a carbonyl group; and $R^{24}$ is a monovalent group having a hydrogen atom, an alkyl group having 1 to 20 carbon atoms, a hydroxyl group, a carboxyl group, an ester group, a vinyl group or a cyclic ether group.

14. The transfer-type image recording method according to claim 13, wherein the condensation product has a ratio of a number of alkylene oxide units to a number of siloxane bonds of 0.1 to 1.2.

15. The transfer-type image recording method according to claim 13, wherein the at least one hydrolyzable siloxane compound comprises:

the at least one organic silicon compound represented by the general formula (1) or (2); and at least one hydrolyzable siloxane compound represented by general formula (3) or (4):

$$(R^{30})_t\text{-}Si\text{-}(R^{31})_{(3-t)} \quad (3),$$

where $R^{30}$ is a nonhydrolyzable alkyl group; $R^{31}$ is a hydrolyzable group; and t is an integer of 0 to 2;

$$(R^{42})-\underset{\underset{(R^{43})_u}{|}}{Si}-(R^{44})_{(3-u)}, \quad (4)$$

where $R^{42}$ is a nonhydrolyzable polymerizable group; $R^{43}$ is a nonhydrolyzable alkyl group; $R^{44}$ is a hydrolyzable group; and u is an integer of 0 to 2.

16. The transfer-type image recording method according to claim 15, wherein the nonhydrolyzable polymerizable group is a vinyl group or a cyclic ether group.

17. The transfer-type image recording method according to claim 8, wherein the polyalkylene oxide unit is a polyethylene oxide unit.

18. The transfer-type image recording method according to claim 8, wherein a thickness of the surface layer part is 0.1 μm to 10.0 μm.

19. The transfer-type image recording method according to claim 8, wherein the polyalkylene oxide unit has 6 to 100 carbon atoms.

20. A transfer-type image recording apparatus comprising:

an intermediate transfer member;

an ink applying unit for applying an ink to the intermediate transfer member to form an intermediate image; and a transfer unit for transferring the intermediate image to a recording medium, wherein a surface layer part of the intermediate transfer member contains an organic siloxane compound having a siloxane bond and a polyalkylene oxide unit.

* * * * *